United States Patent [19]

Tsutsumi et al.

[11] Patent Number: 5,012,280

[45] Date of Patent: Apr. 30, 1991

[54] COPIER WHICH DELETES INOPERATIVE FUNCTIONS FROM CONTROL PANEL

[75] Inventors: Takashi Tsutsumi, Tokyo; Shozo Miyawaki, Urawa; Kouichi Kanaya, Yokohama, all of Japan

[73] Assignee: Ricoh Company, Ltd., Tokyo, Japan

[21] Appl. No.: 430,588

[22] Filed: Nov. 1, 1989

[30] Foreign Application Priority Data

Nov. 9, 1988 [JP] Japan ..... 63-283375

[51] Int. Cl.[5] ..... G03G 21/00

[52] U.S. Cl. ..... 355/206; 340/712; 355/200

[58] Field of Search ..... 355/200, 206, 209, 210, 355/133, 201, 202; 340/712, 784, 711; 341/20, 33, 34, 22, 23; 178/18; 358/444, 468

[56] References Cited

U.S. PATENT DOCUMENTS 4,332,464 6/1982 Bartulis et al. ..... 355/243 X
4,711,560 12/1987 Hosaka et al. ..... 355/200
4,799,083 1/1989 Knodt ..... 355/200 X
4,803,463 2/1989 Sado ..... 340/712 X
4,814,824 3/1989 Ito et al. ..... 355/200
4,870,458 9/1989 Shibuya et al. ..... 355/200
4,896,223 1/1990 Todome ..... 358/468

FOREIGN PATENT DOCUMENTS 0208641 11/1984 Japan ..... 340/712

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

An operating panel of a copying apparatus including an operation mode for setting a function selected from a plurality of functions of the copying apparatus. The operating panel includes a display surface provided with a touch panel sensor device. By manipulating the display surface, the function can be designated and the designation can be cancelled. The designated function is deleted from the display surface. Inputs relating to the designated function are made inefficient so that the function becomes inoperative.

12 Claims, 17 Drawing Sheets

ENTRY
USER PRGRM SELECTED?
N
Y
TRAY 1 USED ?
N
Y
TRAY 1 TRBL ?
Y
N
TRAY 2 USED ?
N
Y
TRAY 2 TRBL ?
Y
N
CHANGE TRAY AND WARN
OTHER TRAY CHECK
ADF USED?
N
Y
ADF TRBL ?
Y
N
CHANGE TO PR. PL. MODE AND WARN
SORTER USED ?
N
Y
SORTER TRBL ?
Y
N
CHANGE TO CLEAR MODE AND WARN
EXIT

COPIER WHICH DELETES INOPERATIVE FUNCTIONS FROM CONTROL PANEL

BACKGROUND OF THE INVENTION

The present invention relates to a manual operating panel of a copying apparatus.

Multi-function copying apparatuses have been developed these days. The copying apparatuses of today are equipped with various functional units of different functions, which makes the manual operating panel thereof complicated. Examples of the functions of the copying apparatus are a binding margin spacing function, a both-side copying (double copying) function and a variable magnification function, etc. Also, in addition to these functions (functional units), copying apparatuses of today can comprise a multi-stacked paper feeding unit which comprises a plurality of vertically stacked paper containers for different sized papers and selectively supplies a copying paper of desirable size and a sorter unit which performs a sorting function of the copies.

With respect to the multi-stacked paper feeding unit, for example, of the above-mentioned various kinds of functional units of the copying apparatus, problems of the prior art are as follows.

When one of the paper container units (paper trays or cassettes) malfunctions and jams, which is not rare in the copying apparatus, it is not desirable to stop the whole operation of the copying apparatus until the paper container is repaired from the stand point of operational rate of the apparatus and productivity of copy products since the other parts of the copying apparatus are able to be operated. When such a copying apparatus in a partially out of order state is to be used without operating the paper container in trouble, no problem arises if the operator knows that one of the paper containers malfunctions to jam so that he or she can avoid using the defective paper container and operate the remaining paper containers in a normal state instead.

However, if the operator does not know that the paper feeding unit malfunctions, he or she may select the defective paper container unit after resetting the copying apparatus to use a copy paper of desirable size, which results in jamming of the paper.

This problem can be solved by drawing out the paper cassette from the defective compartment of the unit and maintaining the compartment vacant. However, such a way to solve the problem is not only inconvenient but also apt to result in failure since somebody may set the paper cassette in the defective compartment.

In addition to the above-mentioned problem of the paper feeding unit, with regard to the multi-function copying apparatus, there is a case wherein the user of the apparatus does not require all of the functions and a simple copying function may satisfy the user's requirement so that the other functions are not utilized. In such a case, a complicated operating panel for the multi-function copying apparatus is inconvenient to use. Besides, the complicated operating panel causes misoperations of the apparatus since the panel has unnecessary parts for the functional units which are not to be used.

SUMMARY OF THE INVENTION

The present invention was made considering the above-mentioned problems of the prior art. It is therefore an object of the present invention to provide an operating panel of a copying apparatus in which functions in trouble or designated not to be used are deleted from the display of the panel and made inoperative even if an input signal is introduced to the function unit, which makes the operating panel more convenient to manipulate and makes it possible to use the copying appratus having a functional unit (function) in trouble by operating the other functional units without misusing the unit in trouble.

Note that the term "function" in this specification means an operation or operative work and a functional unit for performing the operation or work as well.

The object of the invention can be achieved by an operating panel of a copying apparatus which comprises a function setting mode in which specified functions are selected from a plurality of functions of the copying apparatus so that a display concerning the selected specified functions is deleted from a display panel comprising a touch panel sensor and that input signals relating to the selected specified functions are prohibited from being transmitted to the functions and in which the touch panel sensor designates the specified functions as well as cancels the designation of the specified functions.

When the function setting mode is selected in the operating panel, it is possible to designate a function relating to a functional unit which is in trouble or which is not to be used so that the designated function is deleted from the display panel and made inoperative by prohibiting input to the unit, which makes it possible to use the copying apparatus having a functional unit in trouble or not to be used without misusing the unit by any unspecified person.

Also, the operating panel becomes more convenient to manipulate by deleting display of the function which is to be inoperative from the panel.

When the defective function unit is repaired or the designated function is required to be used, the designation of the function is cancelled so that it becomes possible to use the function unit again.

As mentioned above, in accordance with the present invention, the operating panel of the copying apparatus comprises a function setting mode in which a specified function is selected and designated from a plurality of various functions of the copying apparatus so that a display concerning the designated function is deleted from a display panel having a touch panel sensor so that the designated function unit is made inoperative by prohibiting input of drive signals to the unit and in which the designation of the function to be deleted from the oprating panel as well as the cancellation thereof is performed by manipulating the touch panel sensor of the operating panel.

Therefore, advantages of the above-mentioned operating panel of the copying apparatus are that, when one of the functional units malfunctions or is considered unnecessary for the user, it is possible to designate the functional unit in trouble or the unnecessary unit on the operating panel in the function setting mode, so that the display concerning the designated function is deleted from the display panel and input of the drive signal to the designated functional unit is prohibited so that it becomes possible for an unspecified person to use the copying apparatus which is partially out of order without mistakenly operating the functional unit in trouble, that the operating panel becomes more convenient to manipulate by deletion of the display concerning the defective or unnecessary function from the display panel and that it is possible to use the designated functional unit again by cancelling the designation of the function when the functional unit is repaired or required to be used again.

Further objects and advantages of the present invention will be apparent from the following description of the preferred embodiments of the invention as illustrated in the accompanying drawings.

DESCRIPTION OF THE PREFERRED EMBODIMENTS

An embodiment of the present invention is described hereinafter with reference to the drawings.

Figure 2:
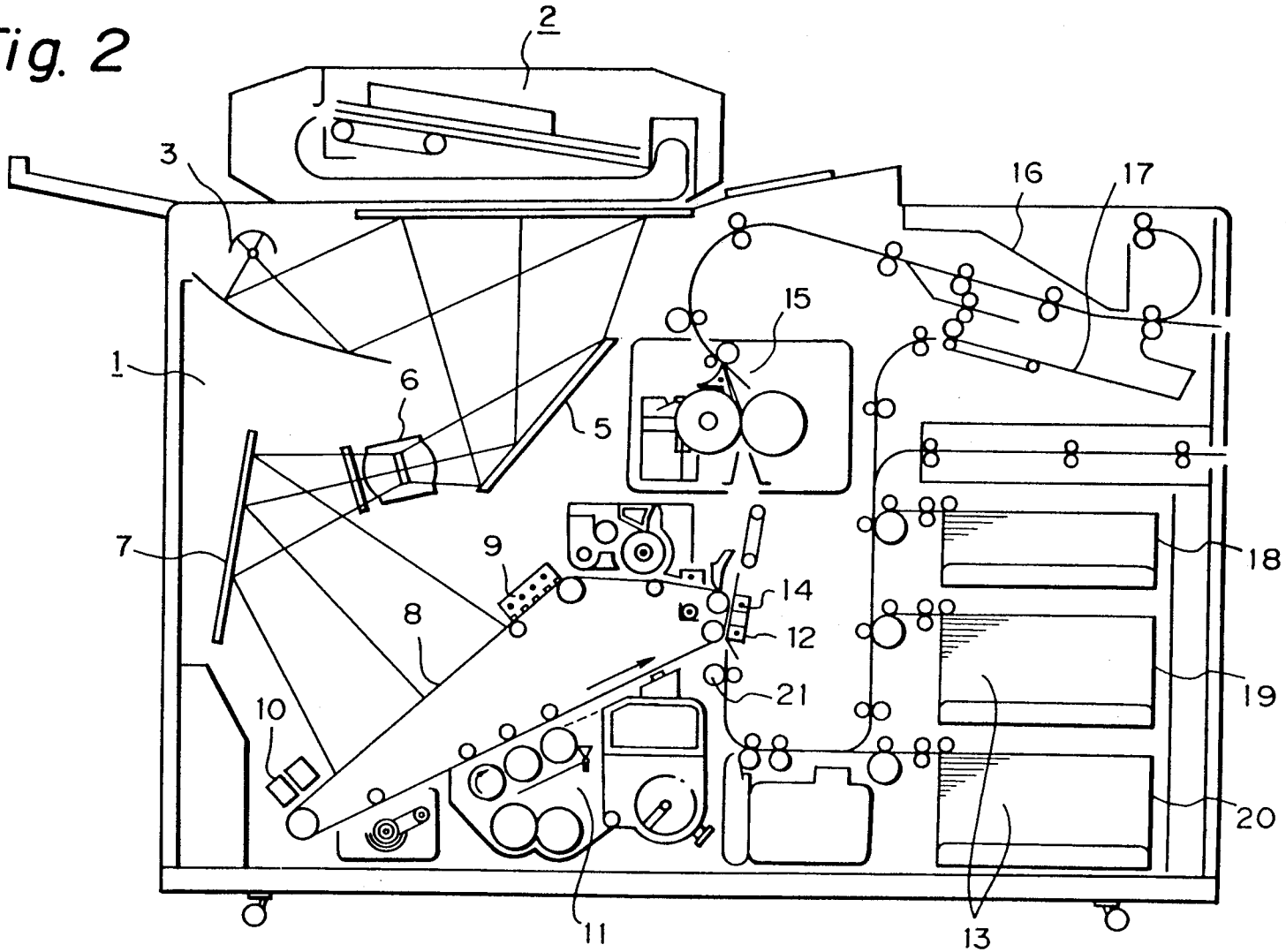
FIG. 2 is a schematic constructional view of the copying apparatus to which the present invention is applied.

FIG. 2 illustrates an example of the copying apparatus which is equipped with an operating panel in accordance with the present invention. The copying apparatus of FIG. 2 comprises an apparatus body 1 on which an automatic document feeder (ADF) 2 for feeding an original is provided. Within the apparatus body 1 is arranged a xenon lamp 3 for conducting a flash exposure of the original on a contact glass. Reflection rays from the original are guided to a belt-shaped photosensitive member (photoconductor) 8 through a first mirror 5, a through lens 6 and a second mirror 7 to expose the photoconductor belt 8. The copying apparatus of this particular embodiment comprises a zooming system of variable magnification from a minimum of 64 percent to a maximum of 142 percent. The photoconductor belt 8 is electrostatically charged evenly beforehand by an electrostatic charger 9. Therefore, an electrostatic latent image is formed on the photoconductor belt 8 when the reflection light exposes the photoconductor belt 8. The latent image on the photoconductor belt 8 passes through an eraser 10 to undergo a necessary erasing treatment there. After that, the latent image formed on the photoconductor belt 8 passes through a development device 11 which develops the electrostatic latent image to form a visible image. The visible image is transferred to a copy paper 13 by a function of a transferring charger 12. After that, the copy paper 13 is separated from the photoconductor belt 8 by a separating charger 14 and conveyed through a fixing device 15 to a copy tray 16. The copy paper is discharged to a double copy tray 17, instead of the copy tray 16, when both sides of the copy paper are to be used as a copy surface on which a copy is formed. Or otherwise, the copy paper 13 is coveyed and discharged to a sorter which is optionally attached to the copying apparatus. Three sorters at most can be attached to the copying apparatus of this embodiment.

The copy paper 13 is selectively fed from one of three paper trays 18,19,20 stacked vertically one above the other or fed from a large amount paper tray which is optionally attached to the copying apparatus. A resist roller 21 controls and adjusts the position of the copy paper with respect to the image formed on the photoconductor belt 8.

Figure 3:
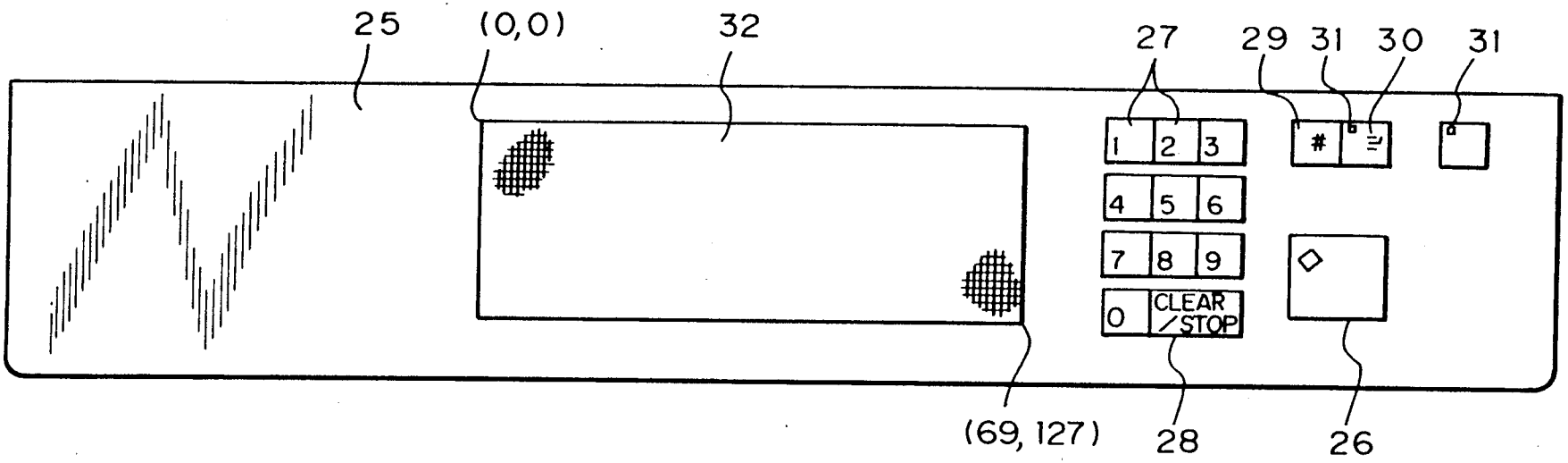
FIG. 3 is a plan view of the operating panel in accordance with the present invention.

FIG. 3 illustrates an operating panel 25 mounted on an upper surface side of the copying apparatus body 1. On the operating panel 25 are disposed a start key (print key) 26, copy quantity keys (ten keys) 27 comprising keys of 0 to 9, a clear/stop key 28, enter (#) key 29 and an interruption key 30 as well as an light-emitting diode (LED)31.

Also, the operating panel 25 comprises a full-dot liquid crystal display (LCD) 32 having touch panel sensors arranged to cooperate therewith. The LCD 32 of this particular embodiment comprises 560 dots in a longitudinal lateral line and 128 dots in a vertical row making 71,680 dots in total. By selectively switching on or off any dots selected from the 71,680 dots in the LCD 32, desired letters, marks or colors can be displayed on the LCD 32. An upper surface of the LCD 32 constitutes a transparent touch panel switch which functions as a display and input keys so that when a key portion represented on the display is pressed lightly, the represented key is switched on to input a signal therefrom.

More precisely, eight dots of the 560 dots in the lateral line, i.e. eight bits that constitute one byte constitute one word which is one unit of data treatment by a microprocessor (CPU). Therefore, the liquid crystal display has a display area of 128 dots in the vertical direction and 70 words in the lateral direction. Also, the coordinates of the LCD display 32 can be represented in such a way that the upper left end point in FIG. 3 designates an origin (0,0) and the lower right end point designates a position (69, 127).

Note that the LCD 32 comprises at least two different color layers, i.e. a red display layer and a green display layer, which makes it possible to represent four display colors, i.e. red, green, white and black, by selectively combining the two colors. More precisely, red dots and green dots are disposed alternately on the display panel so that a pair of red and green dots constitute one display unit. Black is represented by switching off both of the red and green dots. Green is represented by switching on the green dot and switching off the red dot. Red is represented by switching on the red dot and switching off the green dot. White is represented by switching on both of the red and green dots.

It is to be noted that a phrase of directions or instructions displayed on the LCD 32 changes according to the operation state of the copying apparatus such as a waiting state, a copying state and a state of trouble, etc. Also, the positions of input keys on the touch panel sensor change accordingly. However, the display represented on the LCD always corresponds to the same input key of the touch panel sensor disposed at the position of the display.

The copying apparatus of this particular embodiment has several operation modes for user and service man which modes are displayed individually on the LCD 32 for arranging and setting the function of the copying apparatus or counting the number of copy papers by manipulating the LCD 32 on the display thereof.

Each of marks and letters displayed on the LCD 32 constitutes a unit of a part program and has a label attached thereto. In order to represent each part on the display, a function "draw" is arranged in the program. The function has a plurality of variations to represent the marks and letters on the display, such as for representing the marks and letters by two colors of black and white, red and black or green and black, or three colors or red, white and black, or green, white and black. Also, the function is to control the segment of each of a plurality of the parts so as to enable the micro processor (CPU) "V30" to refer to the part.

An essential format is "draw_nw (x, y, label name)". In the format, "n" indicates the segment in which the part is registered and "w" indicates that the part is represented by black and white. Also, "x, y" represents the position of the part on the coordinates in the display of LCD 32. Also, "label name" means the name of the part's label.

On the other hand, for the input from the touch panel sensor, a function "touch_sense" is prepared. The format of this function is usually represented by "touch_sense ($x_1$, $y_1$, $x_2$, $y_2$)". The function is to transmit a signal "1" in response to making of the panel switch by pressing the key of the touch panel sensor within a rectangular area defined from a position ($x_1$, $y_1$) to ($x_2$, $y_2$) on the coordinates of the touch panel sensor.

If the format is represented by "touch_sense _x($x_1$, $x_2$)", the function is to transmit a signal "1" in response to pressing of the touch panel sensor key within a range between $x_1$ and $x_2$ along the x coordinate regardless of the y coordinate.

Similarly, if the format is represented by "touch_sense_y ($y_1$, $y_2$)", the function is to trasmit a signal "1" in response to pressing of the touch panel sensor key within a range between $y_1$ and $y_2$ along the y coordinate regardless of the x coordinate.

Figures 4, 4A:
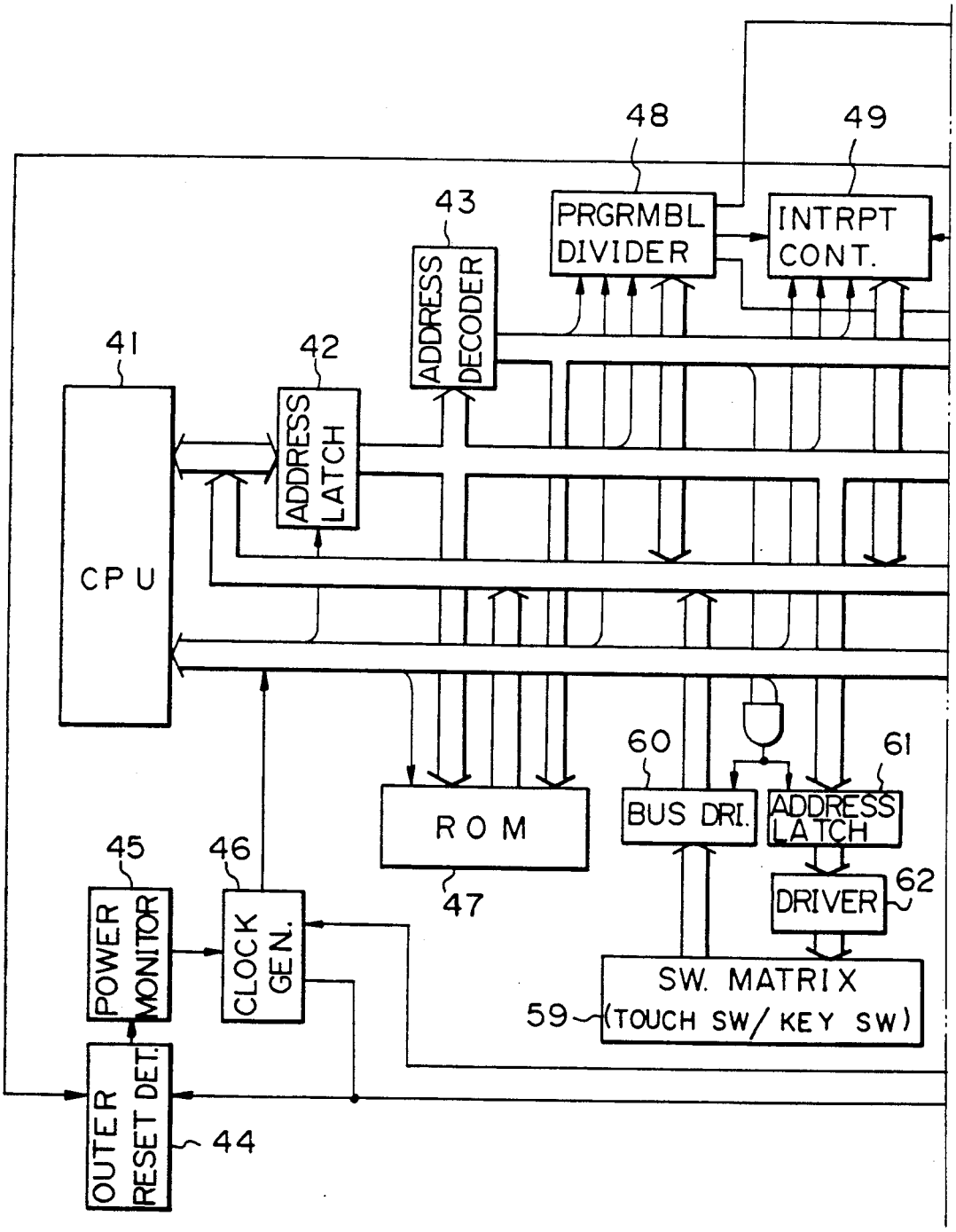
FIGS. 4*a* and 4*b* are a block diagram of an example of the control system of the copying apparatus in accordance with the present invention.
Figure 4B:
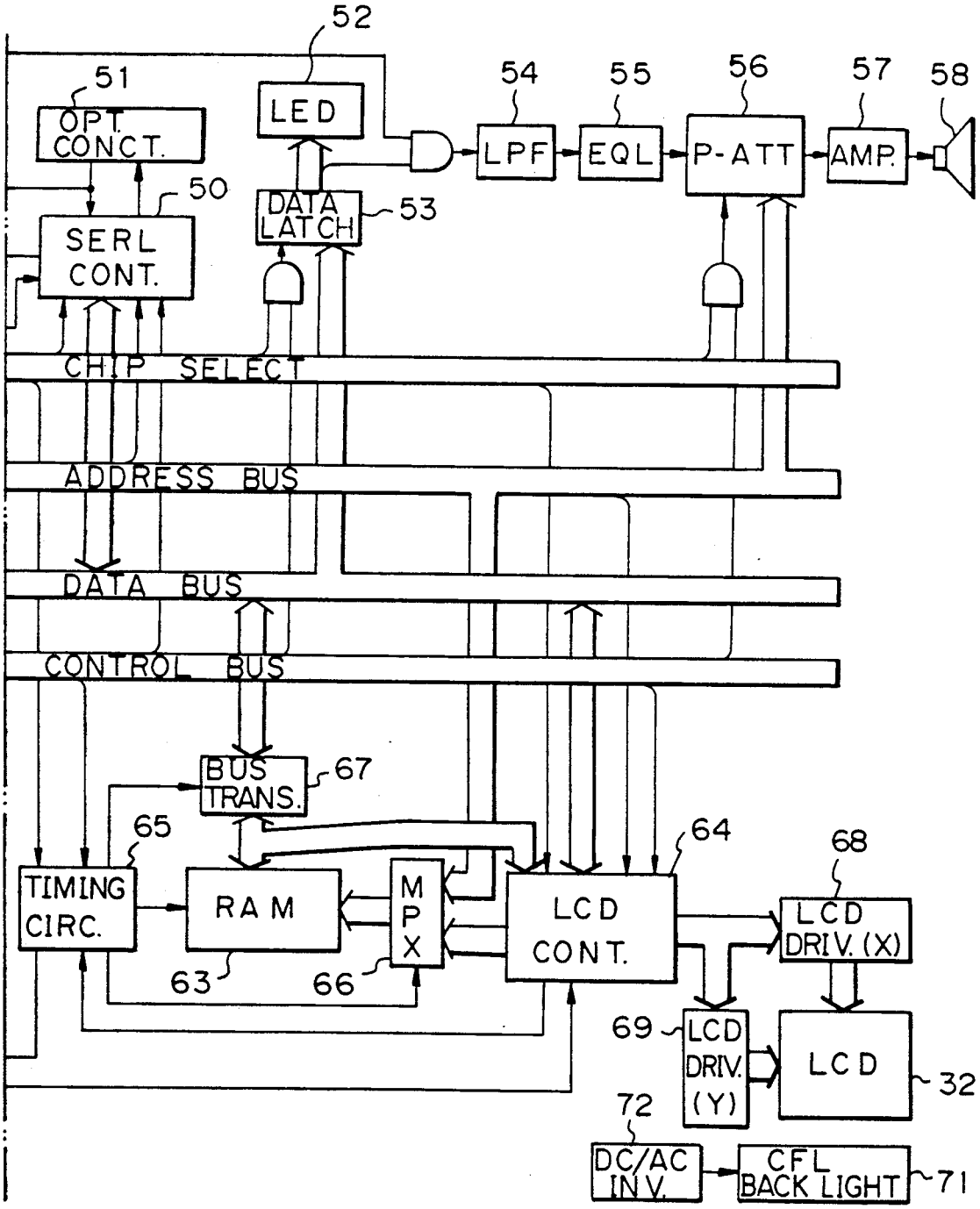

A control system of the copying apparatus in accordance with the embodiment of the present invention is constructed as illustrated by a block diagram of FIG. 4.

A CPU 41 for controlling the whole system outputs an address signal to a data bus in accordance with a time sharing control. The address signal output from the CPU 41 is latched by an address latch 42 and output to the address bus. A high order address on the address bus is decoded by an address decoder 43 and converted to a chip select signal.

An outer reset detector 44 is arranged to check a reset signal transmitted from outside through an optical communication system by comparing the signal with a reference clock signal.

A power monitor 45 is arranged to reset the CPU 41 when power voltage is lowered. The power monitor 45 also resets the CPU 41 when it receives a signal from the outer reset detector 44.

A clock generator 46 outputs a system clock signal. The clock generator 46 also functions to drive a system reset signal and outputs a ready signal to the CPU 41.

A read only memory (ROM) 47 connected to the CPU 41 has a program area and a data area and memorizes all data represented on the display of the LCD 32.

A programmable divider 48 divides the system clock signal and determines a frequency of a buzzer. The programmable divider 48 also outputs a clock signal for determining a baud rate of a serial communication and an interval timer signal.

An interrupt controller 49 transmits an interruption signal to the CPU 41 in response to a timer interruption signal or a receiving interruption signal and a transmitting interruption signal of the serial communication so as to control the interrupting function of the system.

A serial controller 50 is arranged to control the serial communication with outside. An optical connector 51 is an interface connector for conducting the serial communication with outside through optical fibers. An LED 52 is disposed as a display on the operating panel 25 and corresponds to the LED 31 in FIG. 3. A data latch 53 is an output port of the system for latching and outputting on-off signals for the buzzer and the LED 52. A low pass filter (LPF) 54 is arranged to remove higher harmonic components from the square wave signal output from the programmable divider 48 so as to form a sine wave signal adequate to produce a buzzer sound. An equalizer (EQL) 55 is arranged to correct as a whole the frequency characteristic of the low pass filter 54, a programmable attenuator (P-ATT) 56, an output amplifier 57 and a speaker (buzzer) 58. The programmable attenuator 56 attenuates the buzzer sound signal in accordance with a data processing signal from the CPU 41 so as to adjust the sound volume of the buzzer. The output amplifier 57 amplifies the buzzer sound signal adjusted by the P-ATT 56 by a predetermined constant level and drives the speaker 58.

A switch matrix 59 comprises a group of 16×64 touch switches and a group of 16×1 key switches constituting a switch matrix of 16×65 switches as a whole which is disposed in the actual touch panel sensor. The CPU 41 registers the state of all switches of the switch matrix 59 in a buffer memory of a random access memory (RAM) 53 so as to refer to the on-off state of each switch during the execution of the program irrespective of the switch response time which is the time from when the CPU 41 starts to access till when the switch data is determined and transmitted onto the data bus. Since the data bus has 16 bits, the CPU 41 is able to read 16 switch data at a time. Therefore, the CPU 41 can read all data of the state of the matrix switches by 65 times of the reading operation. The 65 times of the reading operation are periodically executed at a constant interval through an interval timer. A driver 62 is arranged to drive to read one of 65 lines of the switch matrix. Row data (16 bits) corresponding to the line data which is driven by the driver 62 is output from the bus driver 60 to the data bus. The data is fetched in the register of the CPU 41. At the end of the data fetching operation by the CPU 41, the address of the next line to be driven subsequently is latched in the address latch 61 so that the driver 62 can drive to read the next line. By repeating the above-mentioned driving operation, the switch data of 16×65 switches are read by the CPU 41.

The RAM 63 has a work area and a data area for the data to display on the LCD 32 and is accessed also by the LCD controller 64. Therefore, the CPU 41 is in a wait state while the LCD controller 64 accesses the RAM 63 so that the RAM 63 is accessed by a cycle-stealing process. A timing circuit 65 is arranged to transmit a timing signal which is necessary for the cycle-steal accessing process. The address input signal of the RAM 63 is connected to either the CPU 41 side or the LCD controller 64 side by a multiplexer (MPX) 66.

The data bus of the RAM 63 is always connected to the LCD controller 64 except when the CPU 41 executes the access operation when the data bus of the RAM 63 is connected to the data bus of the CPU 41 by a function of a bus-transceiver 67.

The LCD 64 reads the registered data for display from the RAM 63 periodically and transfers the data to LCD drivers 68 and 69. The LCD driver (X) 68 drives each segment of 1120 dots along the lateral (horizontal) direction in the display panel, while the LCD driver (Y) 69 drives each segment of 128 dots along the vertical direction in the display. As mentioned before, the LCD 32 is constituted from 560×128 dots matrix in which red and green dots are disposed alternately along the lateral direction so as to represent four colors by the selective combination of red and green dots. A pair of red and green dots constitutes one picture element. Therefore, the display panel comprises 560×128 picture elements. The display panel is divided into two parts, i.e. an upper display of 64×1120 dots and a lower display of 64×1120 dots. The display duty ratio is 1/64.

A back light 71 such as a compact fluorescent lamp (CFL) is arranged to illuminate the display of the LCD 32 from behind thereof. A DC/AC inverter 72 is arranged to invert DC 24 V input thereto to AC 300 V and supplies the output power to the back light 71.

The copying apparatus having the above-mentioned construction is operated as follows.

Figure 5A:
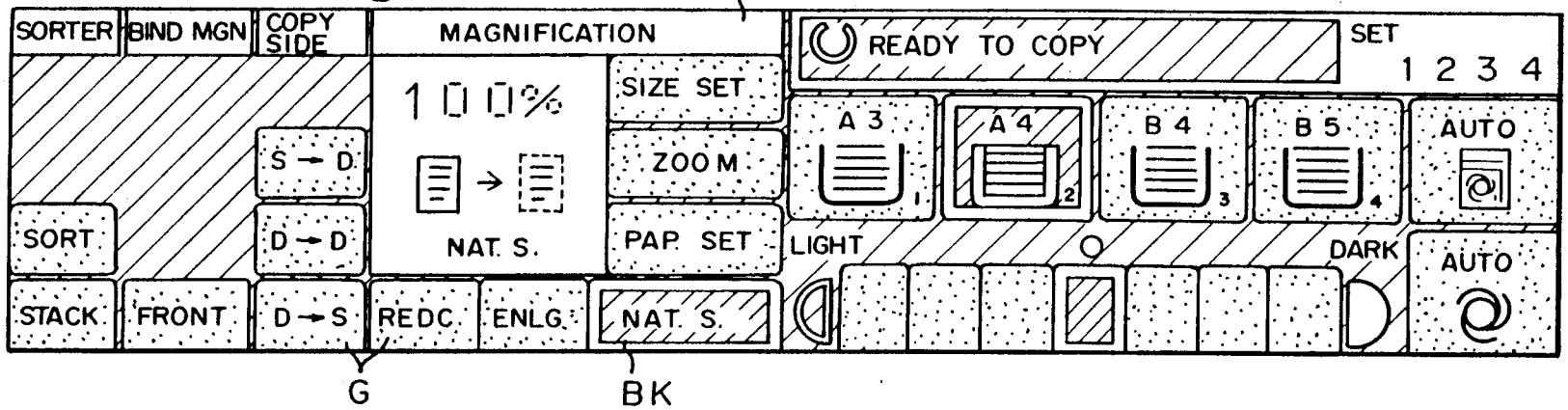
FIG. 5*a* is a plan view of the display panel of the present invention in a waiting state thereof.

First, electric power is supplied to the copying apparatus so that the LCD 32 of the operating panel 25 displays an initial waiting state, as illustrated in FIG. 5*a*, in which information on operation mode and paper size, etc. are represented so that desirable information factors can be selected and input to the copying apparatus.

It is to be noted that in the drawings including FIGS. 5, the display is illustrated by black and white, though red and green can also be represented in the display actually. In the drawings, reference W indicates a white area such as the display ground (FIGS. 1 and 11) and areas for mode title such as "sorter", "binding margin", etc. Reference BK indicates a black area. Reference G indicates a green area which is dotted in the drawings. Letters in the green area are represented by black. Each rectangular green area is a key portion which can be pressed. On the other hand, each rectangular black ground area surrounded by a white frame wherein letters are represented by white is a key portion which is already selected and pressed and not able to be cancelled by being pressed again, such as "NAT.S." (natural scale) and "A4" in FIG. 5*a*.

Figure 5B:
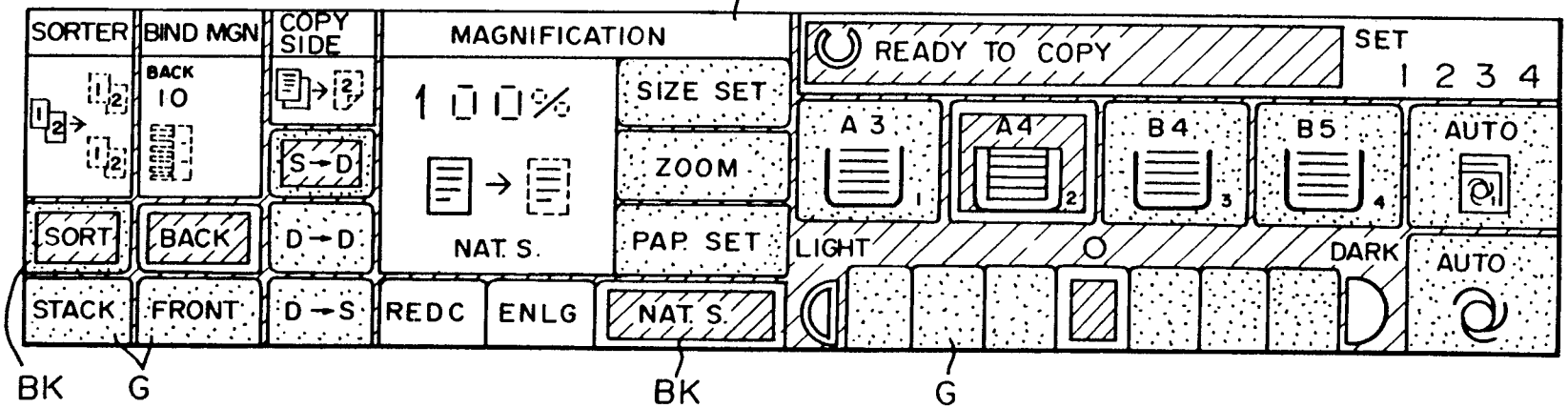
FIG. 5*b* is a plan view of the display panel of the present invention in a state wherein some of operation modes are selected.

FIG. 5*b* represents the LCD 32 in a state wherein some operation modes are selected. In this example, "SORT", "BACK" and "S→D" are selected with regard to the sorter mode, the binding margin mode and the copy side mode, respectively. Each of the selected display key areas is represented by white letters in a black ground surrounded by a rectangular outer frame of green color, being changed from the waiting state of FIG. 5*a*, thus enabling to discriminate the selected modes.

The key portion surrounded by the green frame can be pressed again. By repressing the green framed key, the selected operation mode represented on the key is cancelled. This is in contrast with the key surrounded by a white frame which can not cancel the mode displayed thereon by being repressed.

It is to be noted that, with regard to the binding margin mode, as can be seen from FIGS. 5*a* and 5*b*, when a single side of the paper is to be used to copy the original, only "FRONT" which means a front surface side of the copy paper is displayed on the key panel, whereas when both sides of the paper are to be used to copy the original, "BACK" which means a back surface side of the copy paper is also displayed on the key panel as well as the mode "FRONT" so that one of the surface sides of the copy paper can be selected.

The binding margin is specified in the state of binding margin setting mode by inputting numerals through the ten keys 27.

With respect to the copy side setting mode, it is possible to select one copy side mode from a "S→D" mode for obtaining a double side copy from a single side original, a "D→D" mode for obtaining a double side copy from a double side original, and a "D→S" mode for obtaining a single side copy from a double side original.

With respect to the variable magnification setting mode, it is possible to select one magnification mode from a natural scale mode ("NAT. SC." mode), preset three-stage enlarged magnification modes ("ENLG" mode) of 115%, 122%, 141%, and preset four-stage reduced magnification modes ("REDC" mode) of 93%, 87%, 82%, 71%, by pressing one of the three keys "NAT.S.", "ENLG" and "REDC".

Similarly, the original size and the copy size are input by manipulating a key of variable paper setting mode ("PAP.SET" mode).

Also, copies of any desirable magnification other than the preset scale mentioned above changing by a step of 1% can be obtained by setting the magnification by manipulating a key of a zoom setting mode ("ZOOM" mode) or a size setting mode ("SIZESET" mode).

An upper right portion of the display panel is a message area where a message "READY TO COPY" is displayed in FIGS. 5*a* and 5*b*. An area in the right side of the message area is used for displaying a set number or a count number of copies.

An area below the message area is used for selecting a size of the copy paper by pressing one of four keys numbered 1 to 4. The No. 1 key corresponds to the paper tray 18 of FIG. 2. Also, the Nos. 2, 3 and 4 keys correspond to the paper trays 19 and 20 and the optional large tray (not shown), respectively. The size and the amount of the copy paper stacked in each tray are displayed on each of the keys. A selected key is represented by a color different from the other keys. In FIGS. 5*a* and 5*b*, the No. 2 tray which has A4 size papers therein is selected.

On the right side of the No. 4 key is disposed an automatic paper setting key which automatically determines the size of copy paper from the magnification of the copy and the size of the original.

Below the paper size selection area is a copy density (contrast) selection area which comprises seven keys corresponding to seven stages of copy color density from light side to dark side and an automatic density (contrast) setting mode key. In this particular embodiment, a center key of the seven keys is selected. The automatic contrast (copy density) setting mode key determines the copy density automatically in response to the density (contrast) of the original.

It is to be noted that in the embodiment illustrated in FIGS. 5*a* and 5*b*, the display panel is divided into several segments to reliably manage the panel function by aligning the display on the panel with the touch panel sensor disposed in the panel. More precisely, the display panel is divided into segments of "sorter", "binding margin", "copy side", "magnification", "message", "count", "tray", and "contrast (density)". Each segment has its display and functions corresponding to keys of the segment. For example, the segment "sorter" has functions named "disp_sorter ( )" and "touch_sorter ( )". The function "disp_sorter ( )" is to display keys and selected operation mode and comprises the function "draw" mentioned before. The function "touch_sorter ( )" is to check whether the displayed key is pressed or not (i.e. whether input is transmitted or not) and comprises the function "touch_sense" mentioned before. Similarly, the other segments have keys and functions thereof.

FIGS. 6 to 9 illustrate a large tray unit which is attached to the copying apparatus body 1 and feed copy papers one by one in response to a paper feed signal. The large tray unit can receive about 1000 to 2000 copy papers therein. The stack of copy papers is mounted on a tray table 81 which is vertically movable and supported by two parallel support axes 81*a* to which a wire 87 is secured at each end thereof. The wire 87 is wound around a plurality of pulleys 85 which is disposed on a side frame of the tray unit. The wire 87 is drive to be moved by a reversible motor 82 for elevating the tray table 81 through a worm 84 and a worm gear 83. By rotating and reversing the motor 82, the tray table 81 is driven to move upward and downward through the wire 87 and the support axes 81*a*.

Figure 7:
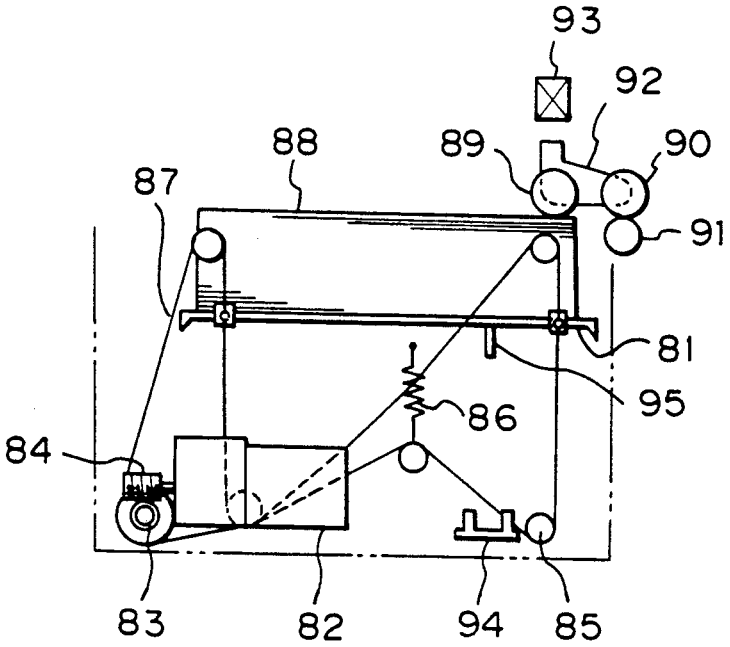
FIG. 7 is a side view of the large tray unit of FIG. 6.
Figure 8:
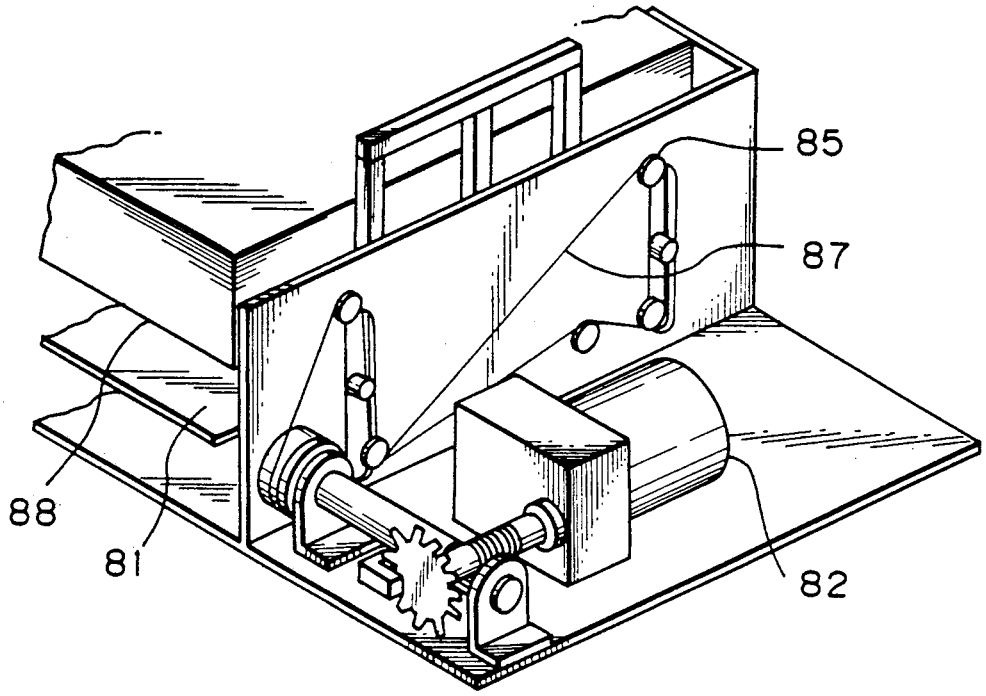
FIG. 8 is an enlarged perspective view of a driving means of the large tray unit of FIG. 6.
Figure 9:
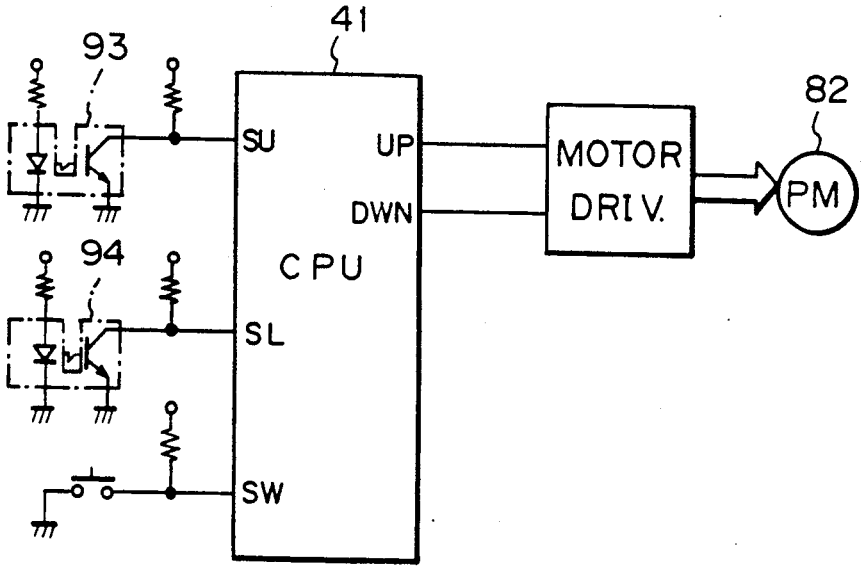
FIG. 9 is a block diagram for controlling the driving means of FIG. 8.

A paper stack 88 is mounted on the tray table 81, as illustrated in FIG. 7. The tray table 81 is driven to move upward in the paper feed operation so that an uppermost paper of the stack 88 is always pressed against a pick up roller 89. The uppermost paper is drawn and fed from the tray table by rotating the pick up roller 89 by a predetermined number of turns in accordance with a paper feed signal. The uppermost paper drawn from the paper stack passes through a pair of separation rollers comprising a feed roller 90 and a reverse roller 91 so as to prevent a double feed of papers so that the copy papers are supplied to the copying apparatus body one by one. Numeral 86 designates a tension spring.

The pick up roller 89 is attached to an arm 92 which is pivotted to an axis of the feed roller 90 disposed at a predetermined position on the side frame. The pick up roller 89 is attached at a free end of the arm 92 so that the roller 89 can freely move vertically. Therefore, the roller 89 is urged to move upward as the paper stack 88 is elevated so that an interference piece disposed at an upper side of the free end of the arm 92 enters into a photointerrupter 93 which transmits a signal to the control system.

Numeral 94 designates a photointerrupter similar to the photointerrupter 93 mentioned above. The photointerrupter 94 is disposed below the tray table 81 to detect a lower limit position of the tray table 81 when an interference piece 95 secured to the under surface of the tray table 81 enters into the photointerrupter 94 at the time of a descendent motion of the tray table 81.

An essential motion of the above-mentioned tray table 81 is as follows.

When no copy paper is placed on the tray table 81, a paper end sensor (not shown) detects this state whereby the tray table 81 is driven to descend to the lower limit position. Then the tray table 81 is drawn out of the tray unit to mount a paper stack 88 thereon. After that, the tray table 81 is set within the tray unit. This state is detected by a set sensor (not shown) whereby the motor 82 is started to rotate in a direction to lift the tray table 81.

As the paper stack 88 moves upward, it presses the pick up roller 89 to move upward until the interference piece of the arm 92 enters into the upper photointerrupter 93 which then transmits an upper limit signal to the CPU 41 so that the motor 82 for elevating the tray table 81 is stopped and the tray unit gets ready to feed papers.

The papers are fed one by one from the paper stack 88 mounted on the paper table as mentioned before. As the papers are fed, the height of the paper stack 88 reduces. Therefore, the tray table 88 must be driven to be moved upward. Therefore, the elevation motor 82 is driven to rotate in the direction to lift the tray table 81 when the interference piece of the arm 92 descends and disengages from the photointerrupter 93 to keep its uppermost position where the interference piece of the arm 92 actuates the photointerrupter 93 so as to enable the feeding operation by the pick up roller 89 attached to the arm 92.

On the other hand, when the tray table 81 is to be lowered, a descending switch (not shown) is pushed so that the CPU 41 reverses the elevation motor 82 to rotate in the direction to move the tray table downward. When the interference piece 95 secured to the tray table 81 comes to the position of the lower photointerrupter 94 and interrupts the optical path of the detector, the elevation motor 82 is stopped.

As mentioned above, the elevation motor 82 for driving the tray table 81 is controlled by the upper and lower photointerrupters 93 and 94 and the paper end sensor. Therefore, if these sensors, especially the sensors 93 and 94 for detecting the uppermost position and the lowermost position, respectively, should get out of order or disconnected on account of broken wires, the tray table 81 would be impaired and even worse the wire cable 87 for driving the tray table would be broken. Especially, it is critical with regard to the large tray for mounting thousands of papers and driven by a very large output power motor 82.

In such a case of trouble as mentioned above, it is to be avoided to select the function mode using the large tray in trouble or other paper tray 18, 19 or 20 which is apt to misfeed, for example, until the tray is repaired by a service man.

Figure 5C:
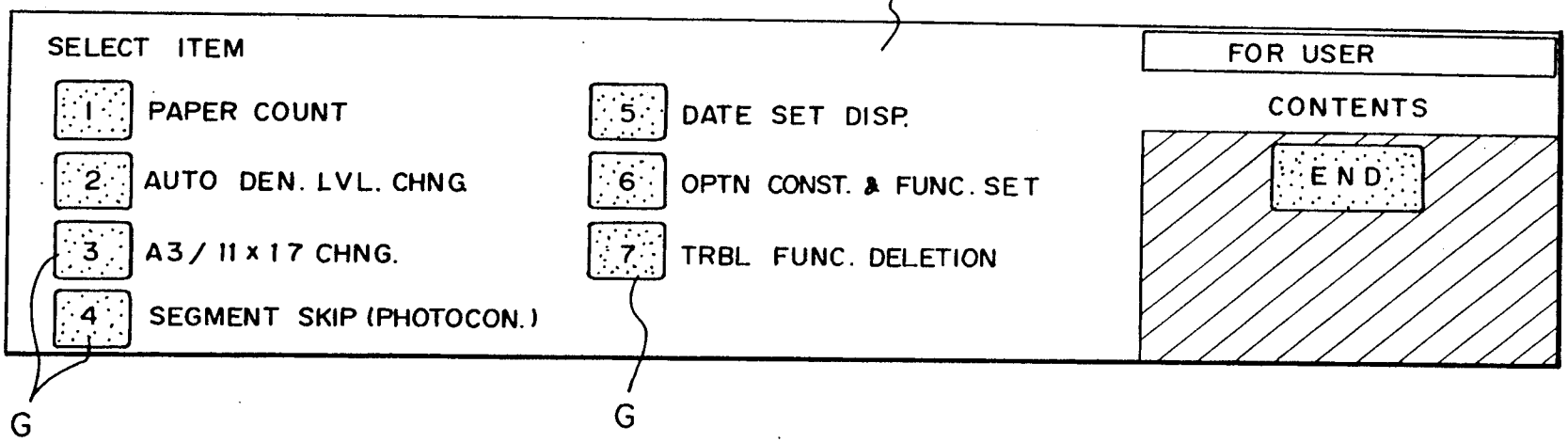
FIG. 5*c* is a plan view of the display panel of the present invention in a state for setting the function mode of the copying apparatus in accordance with the present invention.
Figure 6:
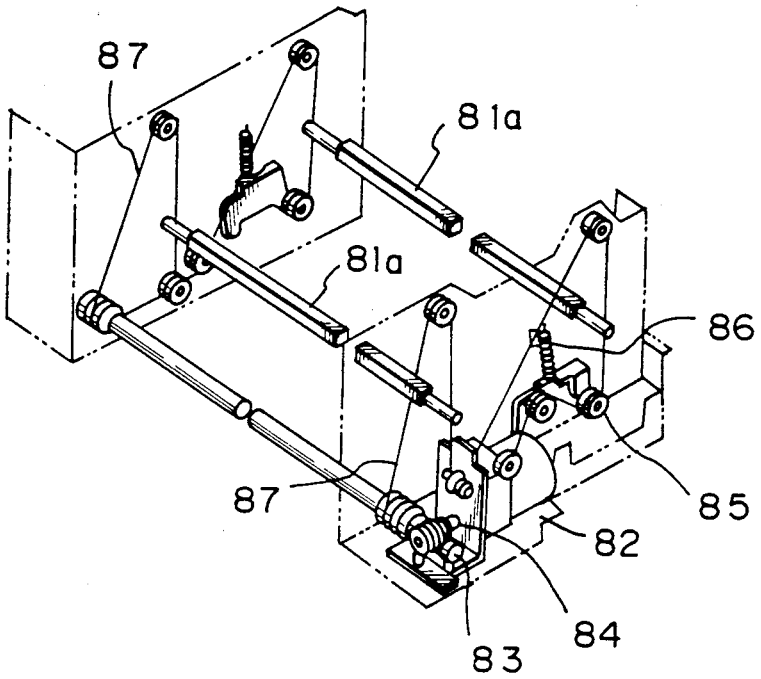
FIG. 6 is a perspective view of the large tray unit in accordance with the present invention.

The present invention enables copying to proceed conveniently during such a situation. A code number is predetermined by the user for displaying menus to be selected by the user on the LCD 32. When the code number is input by the ten keys 28, the LCD 32 represents a menu display for the user as illustrated in FIG. 5*c*. In this menu display, various items selectable for the user are represented as mode titles. On the left side of each mode title is disposed a touch panel switch on which a numeral is put down for calling the mode display of the title on the LCD 32.

Figure 1A:
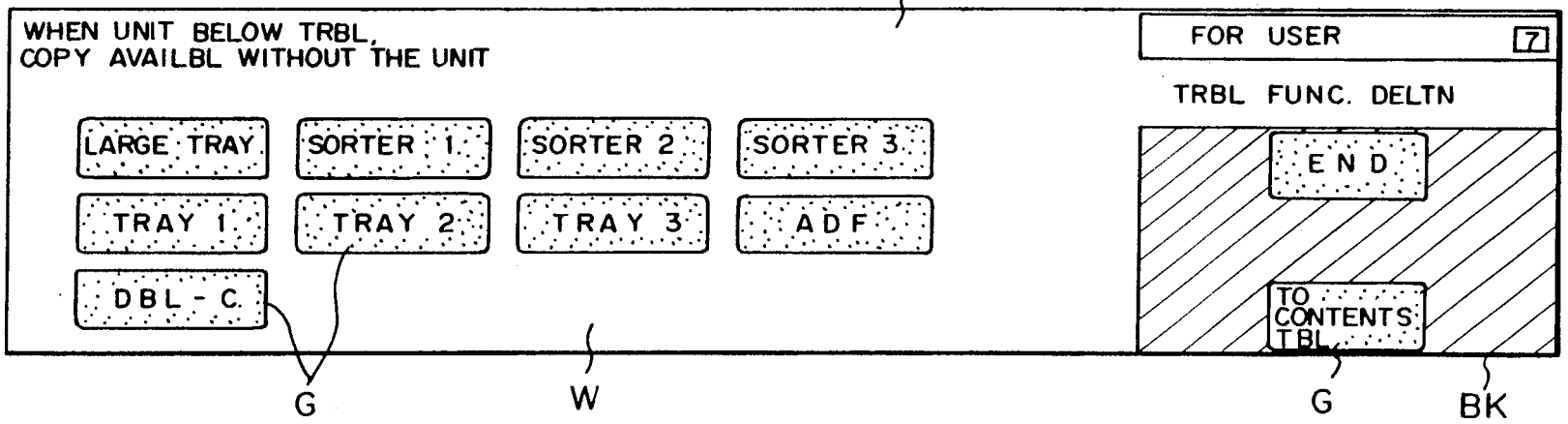
FIG. 1*a* is a plan view of a display panel of an LCD (Liquid Crystal Display) in a state before deleting a function from the display.
Figure 1B:
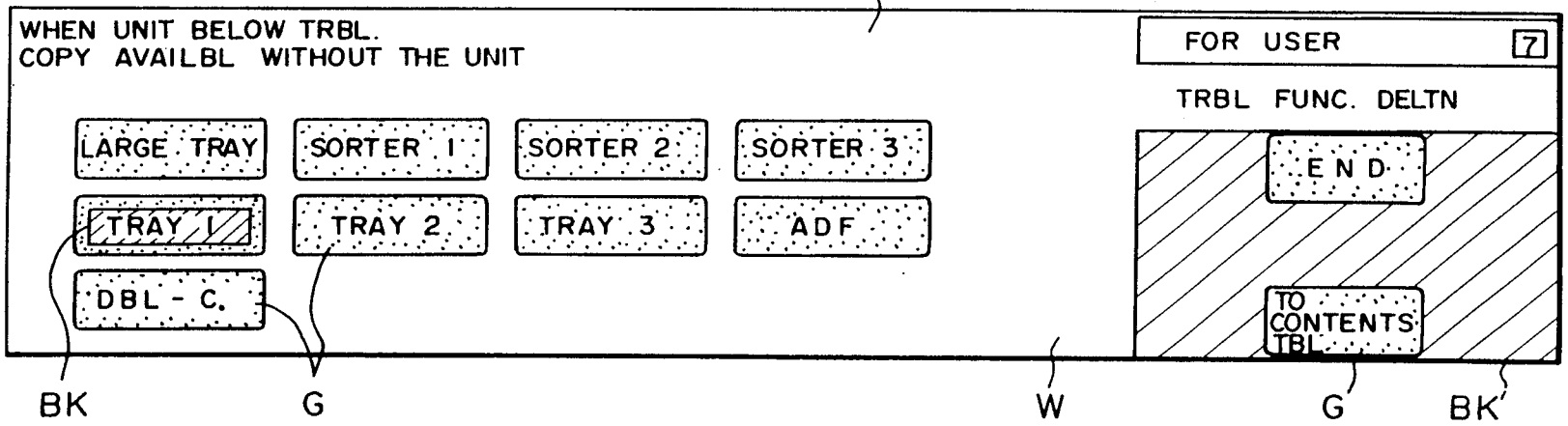
FIG. 1*b* is a plan view of the display panel of the LCD in a state after deletion of the function from the display.

The present invention is featured by the provision of No. 6 mode titled "option construction and function setting mode (OPTN CONST.& FUNC. SET)" and No. 7 mode titled "function in trouble deletion mode (TRBL FUNC. DELETION)". For example, when the No. 1 tray 18 is in trouble, the function using the tray 18 is to be deleted. For this purpose, first, the No. 7 mode titled "function in trouble deletion" is selected by pressing the No. 7 switch in the user mode display of the LCD 32 illustrated in FIG. 5*c*. Thereby, LCD 32 represents an initial display for the No. 7 mode as illustrated in FIG. 1*a*. Here, since the No. 1 tray 18 is assumed to be in trouble, a key represented by "TRAY 1" in the initial display of FIG. 1*a* is pressed to designate that the troubled tray is the tray 18. Then, the ground of the key represented by "TRAY 1" is changed from green to black as illustrated in FIG. 1*b*.

After that, when a key represented by "TO CONTENTS" is pressed, the LCD panel represents again the mode item display for user of FIG. 5*c* so that other modes can be selected.

Figure 1C:
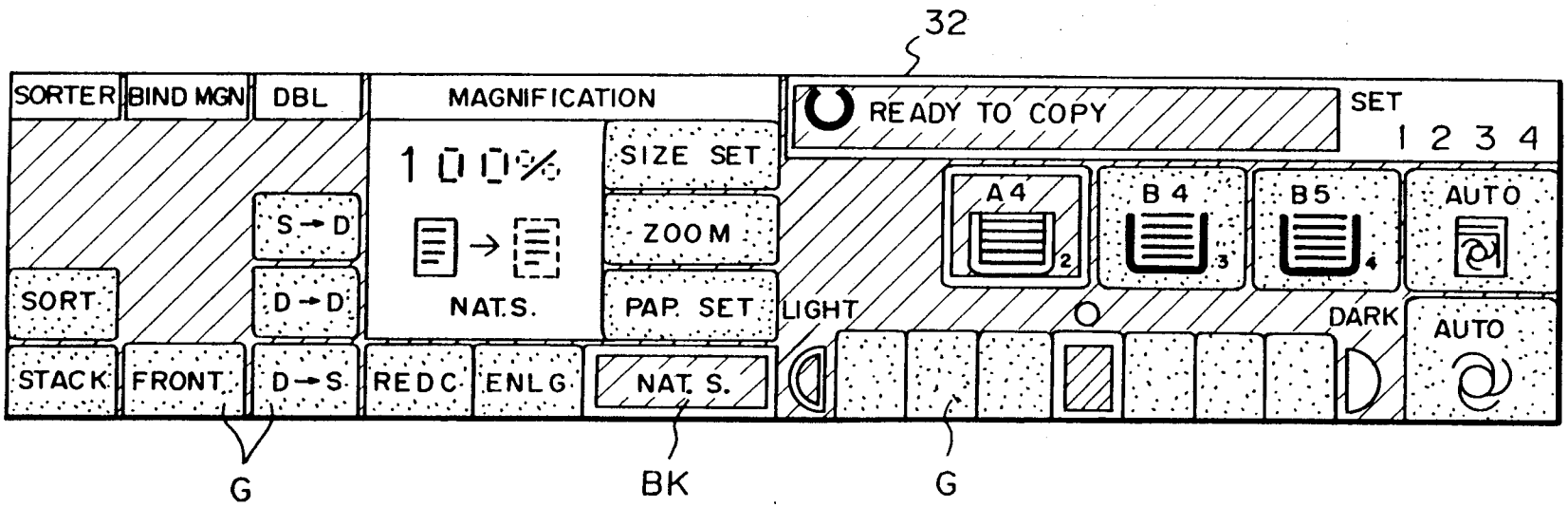
FIG. 1*c* is a plan view of the display panel of the LCD in a state of showing a copying mode when one of the functional units is in trouble and deleted from the panel.

On the other hand, when a key represented by "END" is pressed, the LCD panel represents again the display of FIG. 1*c* informing the state of being ready to copy.

With regard to the display of FIG. 1*c*, it is to be noted that the key portion for the No. 1 tray is deleted from the display, since the function regarding the No. 1 tray 18 which is in trouble is designated to be deleted from the operative functions of the copying apparatus by the mode titled "function in trouble deletion mode" of FIG. 1*a*. In this state, the No. 1 tray 18 can not be selected from the display of LCD 32, i.e. the input from the touch panel switch of No. 1 tray is made ineffective. Therefore, an unspecified person can avoid selecting the tray 18 which is in trouble and obtain normal copies by using the remaining trays 19, 20 and 81 instead, in accordance with the display of LCD 32 illustrated in FIG. 1*c*, even if the person is not informed of the state that the tray 18 is in trouble.

This is applied in the same manner as mentioned above to a state wherein one of the other trays 19 and 20 or the tray table 81 gets out of order. Also, the operating panel 25 of the copying apparatus in accordance with the present invention can delete the display of another operation mode other than that of the paper feed unit mentioned above and make the input thereto inefficient when a unit other than the paper feed tray unit is in trouble, as in a case of trouble with regard to a unit of the automatic document feeder 2, a unit of the optional sorter which comprises three sorter units at most represented as "SORTER 1", "SORTER 2" and "SORTER 3", respectively, in the display panel, or a unit concerning the double copying operation wherein both sides of the copy paper are used as a copy surface.

A process for coping with a case wherein the tray table 81 of the large tray unit gets in trouble is described hereinafter with reference to FIGS. 10*a* to 10*f*.

In this case, the key represented as "LARGE TRAY" is pressed in FIG. 1*b* instead of "TRAY 1". The key of "LARGE TRAY" corresponds to the No. 4 tray which comprises the tray table 81 which is in trouble. By designating the No. 4 tray as the troubled tray, a signal "1" is input to an address "FG_MAL_TRAY_4" prepared in a nonvolatile memory so that the state that the tray (tray table 81) is nonusable is memorized.

After setting the mode of the function to be deleted as mentioned above, the key portion represented as "END" is pressed so that the LCD represents a display of being ready to copy wherein the key portion for the No. 4 tray is deleted.

The function of the specified large tray unit is controlled as follows.

First, when the No. 4 tray which corresponds to the large tray unit is designated to be deleted, in addition to that a signal "1" is input to the address named "FG_MAL_TRAY_4" prepared in the nonvolatile memory, the tray table 81 is moved down to the lower limit position by driving the elevation motor 82 to rotate in the direction of lowering the tray table 81. Once this state is set, the tray table 81 never moves upward if the power switch is reset to turn on again or the tray table is reset in the tray unit after withdrawing therefrom temporarily. That is, the tray table 81 is maintained inoperative so that papers can not be fed from this tray unit unless the designation to delete the function thereof is cancelled.

When the designation to delete the selected function is to be cancelled, the ten keys 28 are manipulated so that the LCD panel represents the display of "function in trouble deletion mode (TRBL FUNC.DELTN)" illustrated in FIG. 1*a* again so as to repress the key for the designated mode. Thereby the designated mode is erased from the nonvolatile memory, thus the LCD panel returns to the state wherein it is possible to input signals to the designated unit for executing the function as well as that the deleted function mode is displayed in the panel again.

The flow charts of FIGS. 10*a* to 10*f* explain the control sequence of the above-mentioned function of the large tray unit.

Figure 10A:
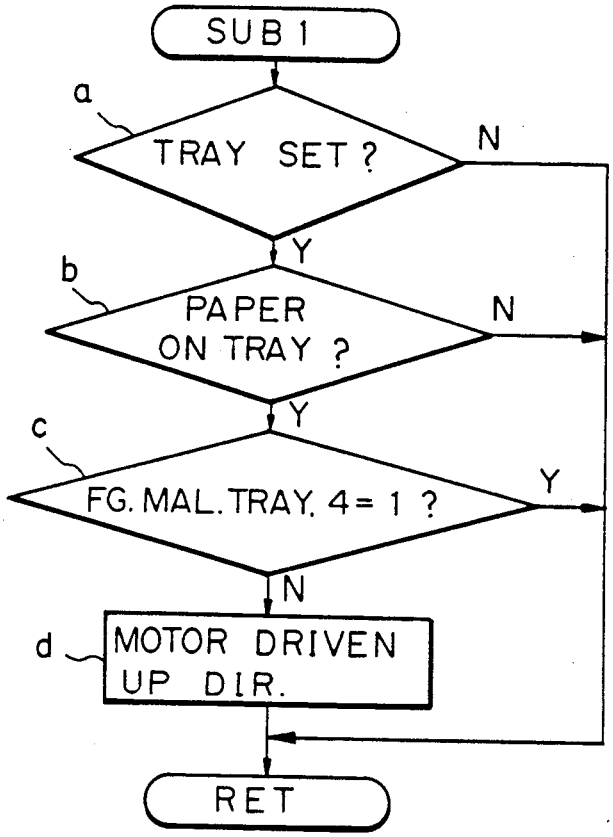
FIG. 10*a* is a flow chart of a control means for controlling the large tray unit representing a first subroutine for lifting a tray table at the time when the large tray unit is set in the copying apparatus body.

First, FIG. 10*a* represents a first subroutine 1 for lifting the tray table 81 at the time when the large tray unit is set in the copying apparatus body 1 (step (a)). The CPU subsequently discriminates whether the paper stack 88 is placed on the tray table 81 or not (step (b)) and whether a signal "1" is transmitted to the address "FG_MAL_TRAY_4" which means that the No. 4 tray for the tray table 81 is in trouble or not (step (c)). If the paper stack is mounted on the tray table and the address is not the level of "1", the elevation motor 82 is driven to rotate in the direction of elevating the tray table 81 (step (d)).

Figure 10B:
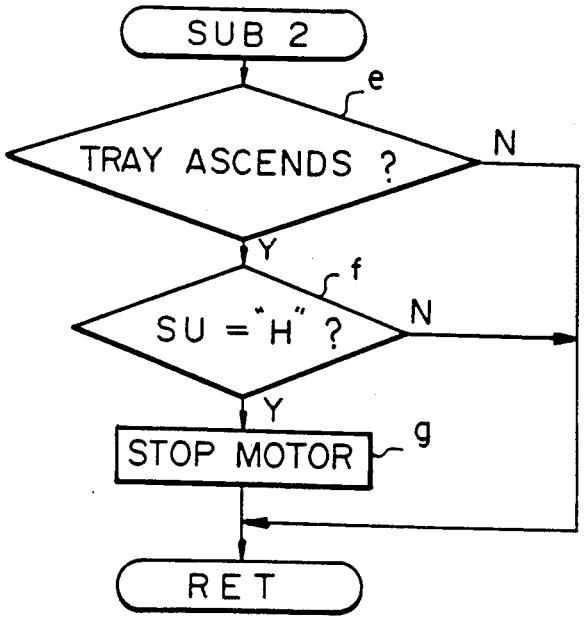
FIG. 10*b* is a flow chart of the control means for controlling the large tray unit representing a second subroutine for stopping the lifting motion of the tray table at an upper limit position.

FIG. 10*b* represents a second subroutine 2 for stopping the elevating tray table 81 at the upper limit position. In step (e), the CPU discriminates whether the tray table 81 is ascending or not. Step (f) is to discriminate whether the upper limit sensor detects the tray table 81 and transmits a signal of level "H" or not. If the detection signal is changed to level "H", the elevation motor 82 is stopped (step (g)).

Figure 10C:
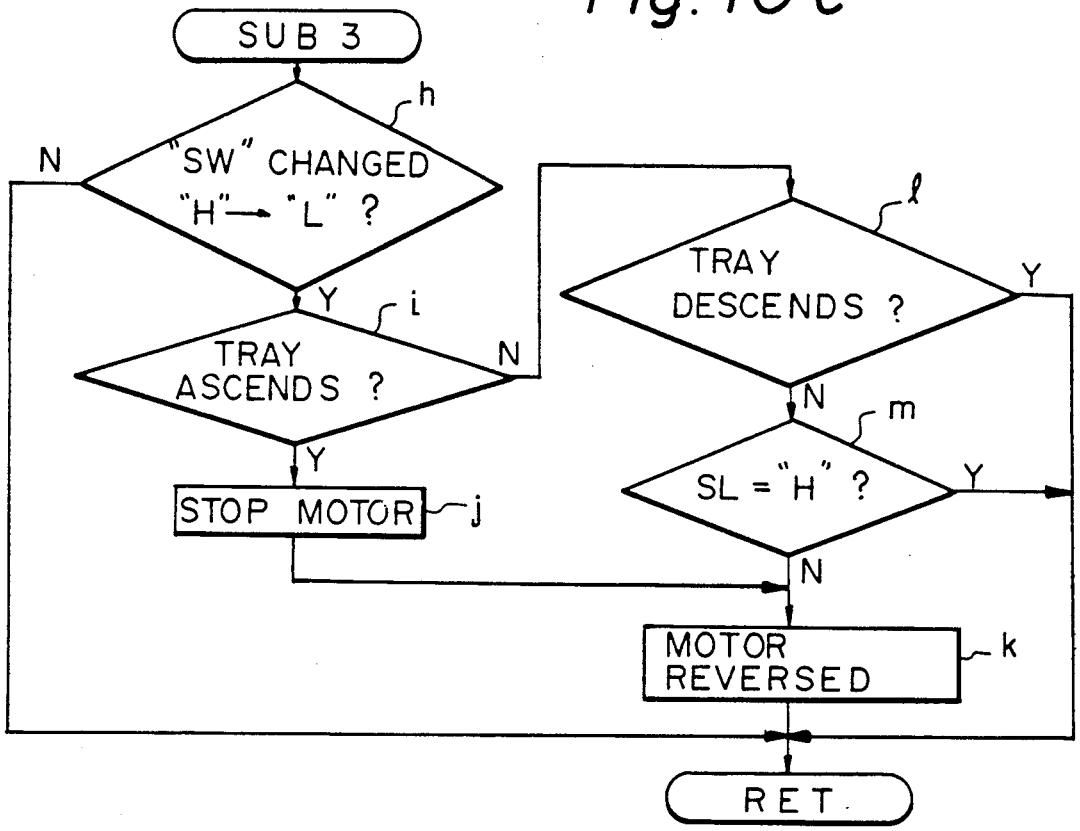
FIG. 10*c* is a flow chart of the control means for controlling the large tray unit representing a third subroutine for moving downward the tray table from the upper limit position.

FIG. 10*c* represents a third subroutine 3 for driving the tray table 81 to move downward from the upper limit position by the lowering switch. When the detection signal from the lowering switch is changed from level "H" to level "L" (step (h)), if the tray table 81 is moving upward (step (i)), the elevation motor 82 is stopped temporarily (step (j)). After that, the motor 82 is reversed (step (k)). If the tray table 81 is being stopped, i.e. not ascending (step (i)) nor descending (step (l)), and the detection signal of the lower limit sensor is not level "H" (step (m)), i.e. the tray table 81 is not at the lower limit position, the elevation motor 82 is driven to rotate in the direction of moving the tray table downward (step (k)).

Figure 10D:
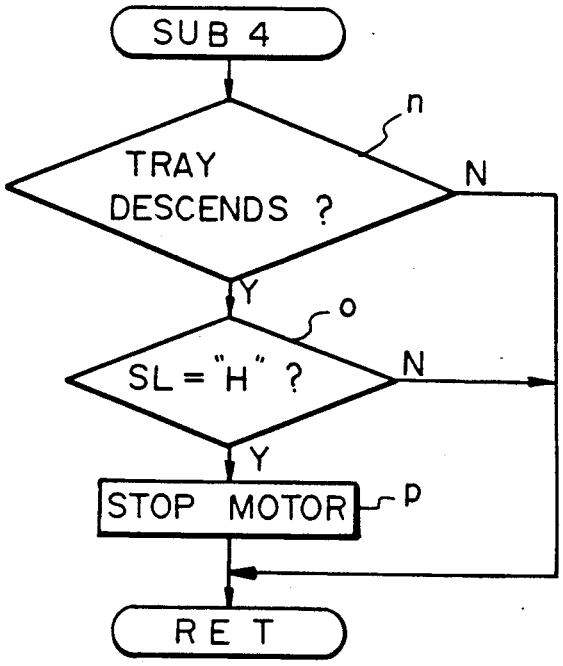
FIG. 10*d* is a flow chart of the control means for controlling the large tray unit representing a fourth subroutine for stopping the tray table at a lower limit position.

FIG. 10*d* represents a fourth subroutine 4 for stopping the tray table 81 at the lower limit position. Step (n) is to discriminate whether the tray table 81 is descending or not. If descending, when the detection signal of the lower limit sensor is changed from level "L" to level "H" (step (o)), i.e. the tray table 81 comes to the lowermost position, the motor 82 is stopped (step (p)).

Figure 10E:
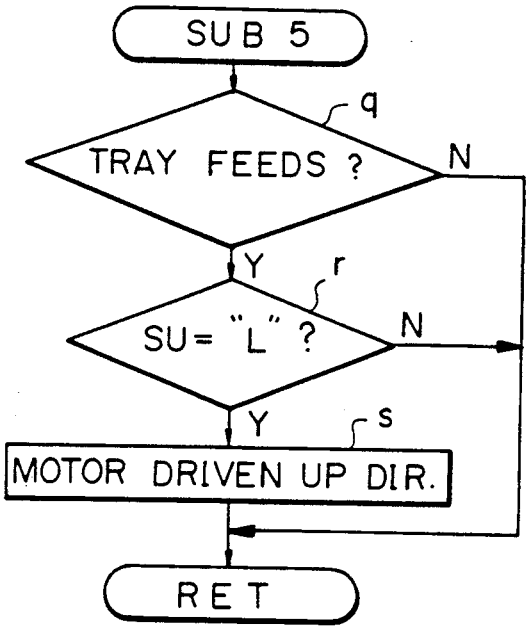
FIG. 10*e* is a flow chart of the control means for controlling the large tray unit representing a fifth subroutine for moving upward the tray table according as the copy papers decrease.

FIG. 10*e* represents a fifth subroutine 5 for elevating the tray table 81 as the height of the paper stack decreases in the paper feeding motion. Step (q) is to discriminate whether the tray table 81 is in the state of feeding papers therefrom or not. In the state of feeding papers, if the detection signal of the upper limit sensor is changed to level "L" (step (r)), i.e. the uppermost surface of the paper stack placed on the tray table descends from the upper limit position, the elevation motor 82 is driven to rotate in the direction of lifting the tray table 81 (step (s)).

Figure 10F:
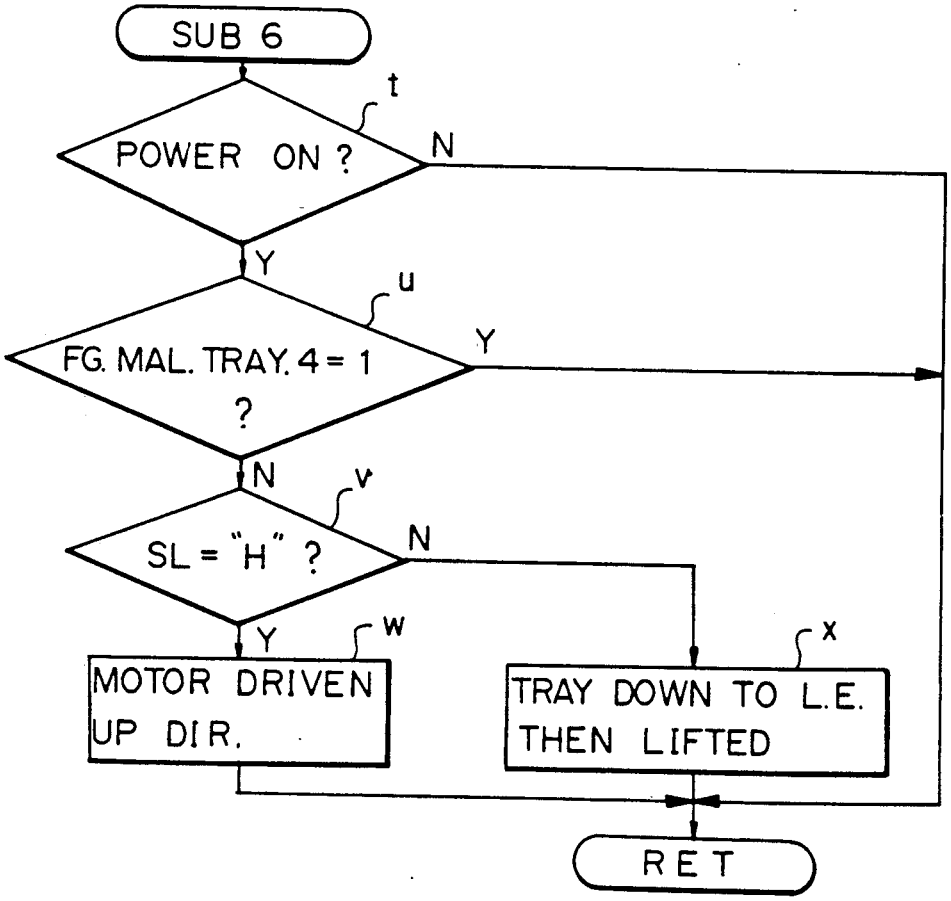
FIG. 10*f* is a flow chart of the control means for controlling the large tray unit representing a sixth subroutine for lifting the tray table at the time of switching on the power.

FIG. 10*f* represents a sixth subroutine 6 for elevating the tray table 81 at the time of switching on the power source. When the power is switched on (step (t)), the CPU discriminates whether the large tray unit of the tray table 81 is designated as being in trouble or not by the signal level of the memory address "FG_MAL_TRAY_4" (step (u)). If the signal level is not "1", i.e. the tray unit is not designated as being in trouble, and the detection signal of the lower limit sensor is level "H" (step (v)), i.e. the tray table 81 is at the lower end position, the elevation motor 82 is driven to rotate in the direction of elevating the tray table 81 (step (w)). On the other hand, if the tray table 81 is not at the lower end position in the step (v), the tray table 81 is moved downward first to the lower end position and after that elevated by the motor 82 (step (x)).

As mentioned above, in the particular embodiment of the present invention, when the large tray unit gets out of order, it is possible to designate the large tray unit as being in trouble by manipulating the operating panel in the mode of deleting functions represented in the display of the panel so that functions relating to the large tray unit are deleted from the display of the operating panel and input signals thereto are made ineffective. Thereby the troubled large tray unit is maintained inoperative so that the papers can not be fed from the large tray unit, which makes it possible to avoid that the large tray unit is mistakenly selected to be used for feeding papers, thus preventing further damage.

It is to be noted that in accordance with the embodiment of the present invention, an "option construction and function setting mode" is prepared in addition to the mode for designating the function to be deleted relating to the unit which is in trouble. This mode is to delete the function which is determined by the user not to be used and to be deleted from the display of the LCD 32 of the operating panel 25 through it is normal and operative and to make signals input to the unit relating to the function ineffective.

Figure 11A:
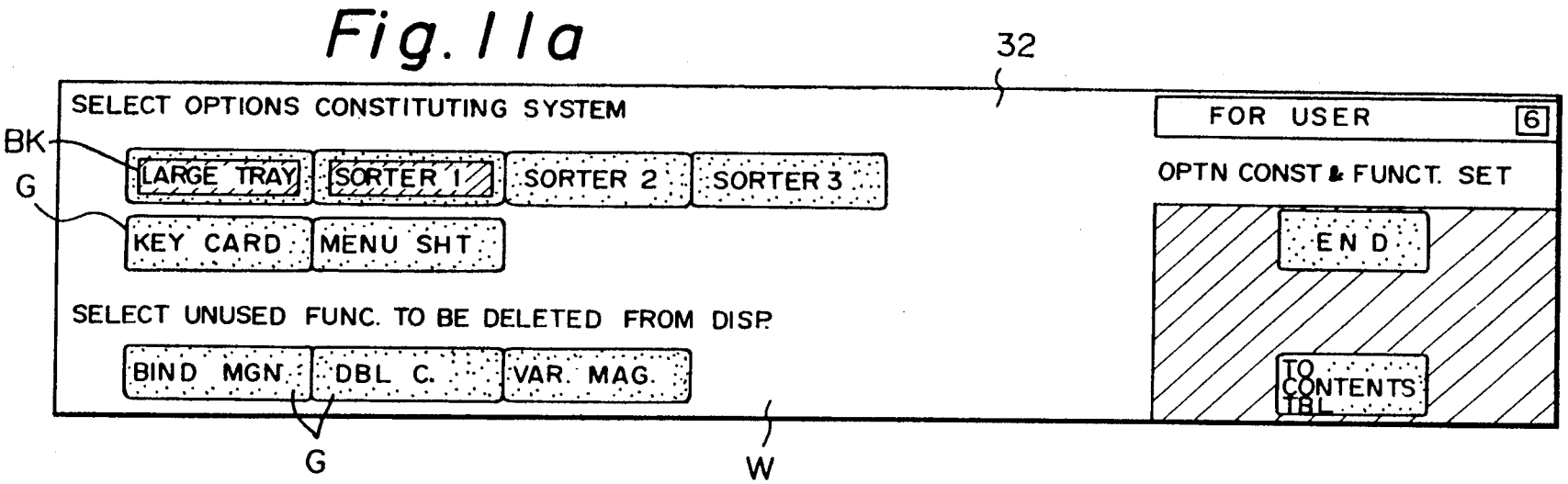
FIG. 11*a* is a plan view of the operating panel of the present invention representing an initial state of optional function setting mode.

For this purpose, first, by manipulating the ten keys 28, the display of menu for the user as illustrated in FIG. 5*c* is represented in the operating panel. The key for the No. 6 mode named "option construction and function setting mode" is selected and pressed so that an initial display of the No. 6 mode illustrated in FIG. 11*a* is represented in the operating panel. As illustrated in FIG. 11*a*, optional units such as the large tray and sorters which constitute the system are selected by pushing the keys for the units. Also, it is possible to select one or more of the functions from "setting binding margin mode", "setting copy side mode" and "setting magnification mode" as functions not to be used. The optional units which are not selected in the option construction setting mode are not used and thus end up to be deleted from the operative units of the copying apparatus.

Figure 11B:
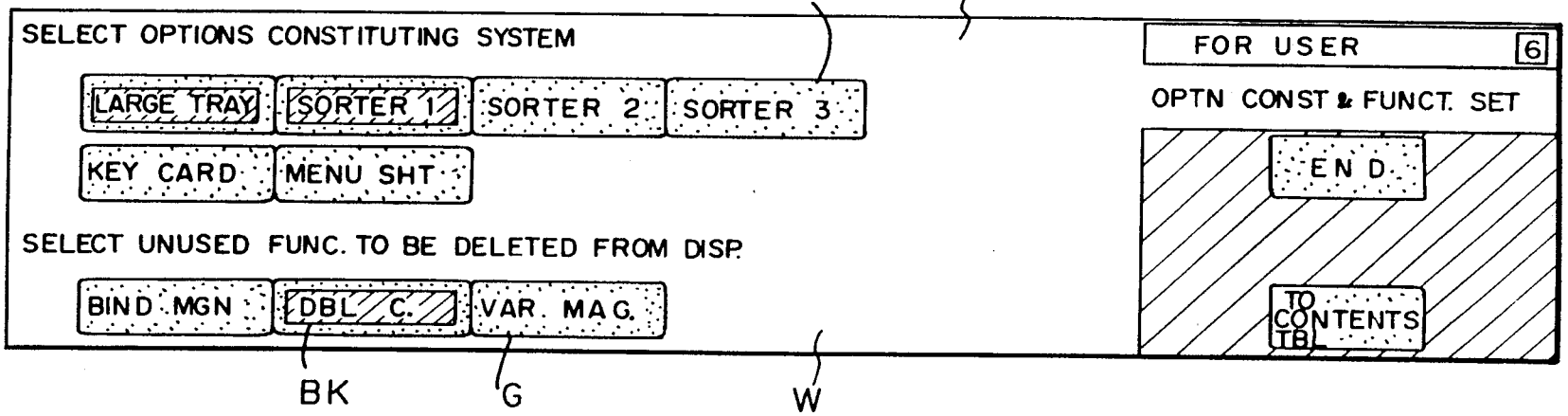
FIG. 11*b* is a plan view of the operating panel of the present invention representing a state in which an unnecessary function is designated on the panel.

In the state of FIGS. 11*a* and 11*b*, "LARGE TRAY" and "SORTER 1" are selected as optional units to constitute the system and "DOUBLE COPY" is designated as a function not to be used.

Figure 11C:
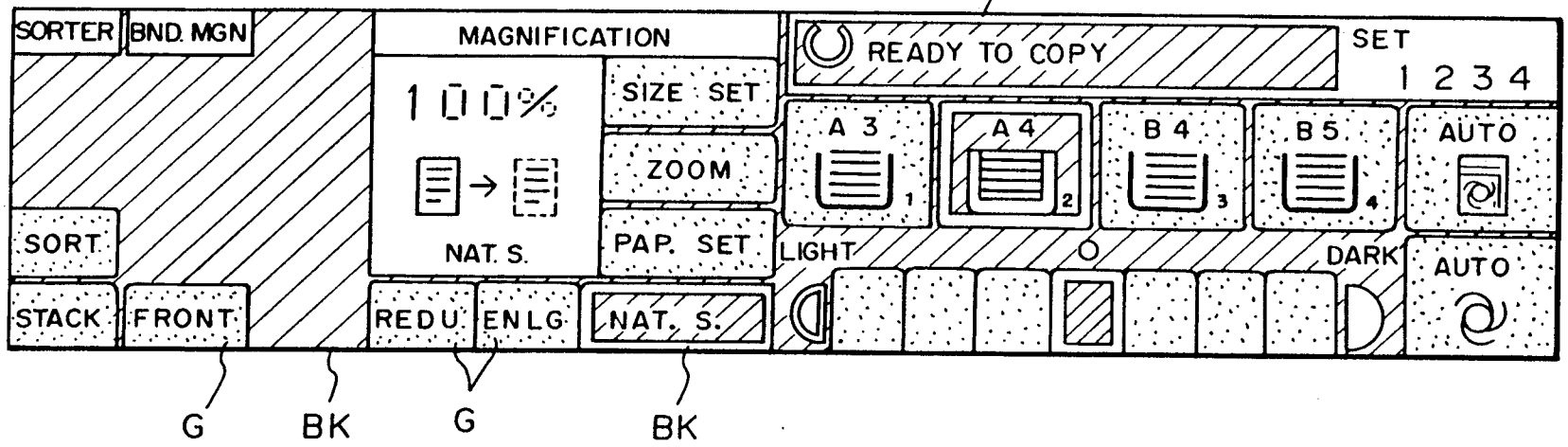
FIG. 11*c* is a plan view of the operating panel of the present invention representing a state in which the copying apparatus is ready to operate.

After that, the key for "END" is pushed so that the display returns to the state of being ready to copy as illustrated in FIG. 11*c*. As can be seen from FIG. 11*c* in comparison to FIG. 5*b*, the display concerning the double copy is deleted from the LCD panel 32 since the "DOUBLE COPY" function mode is designated to be deleted. Also, the signals input to the system from the keys are made ineffective with regard to the double copy function.

When the designated function is to be reused and the function mode is to be redisplayed, the mode of "option construction and function setting" is represented on the display panel again and the key for necessary function is pushed.

As mentioned above, it is possible to delete the display concerning the function designated not to be used, for example the double-side copy function, among the various functions of the copying apparatus. Also, it is possible to make the driving signals ineffective which signals are input from the keys for the units concerning the specified functions. Thereby, it becomes possible to meet the function mode of the copying apparatus with the requirement of the user so that the operation panel becomes more convenient to manipulate, thus avoiding miscopies due to mismanipulation of the display of the operating panel.

In accordance with the present invention, a copying apparatus comprises a user program for processing a copying operation according to a function mode selected by a user from a plurality of copy function modes stored in a nonvolatile memory. The copying apparatus of the present invention can cope with a situation wherein a unit for performing each function gets out of order as follows.

With respect to the function units constituting the copying system such as paper feeding trays 18, 19, 20 and 81, the automatic document feeder 2, sorters 1 to 3, the magnification unit and the double copying unit etc., when a unit gets out of order and malfunctions, the situation of trouble is informed to the control system. The control system discriminates from the information whether the unit in trouble is one which is to be used for processing the function selected in the user program. If the unit to be used is in trouble, the copying mode is automatically changed to another mode in which the unit in trouble is not used. Also, simultaneously with this change of copying mode, information that the mode is changed is displayed as a warning message on the operating panel since the automatically selected new copying mode may not be desirable to the user.

Figure 12:
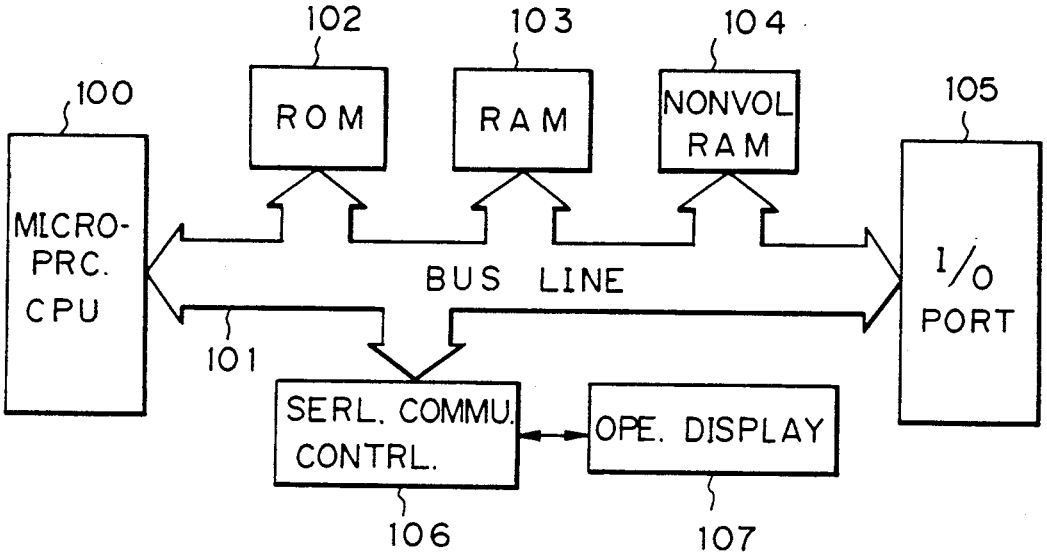
FIG. 12 is a block diagram of another example of the control system of the copying apparatus of the present invention.
Figure 13:
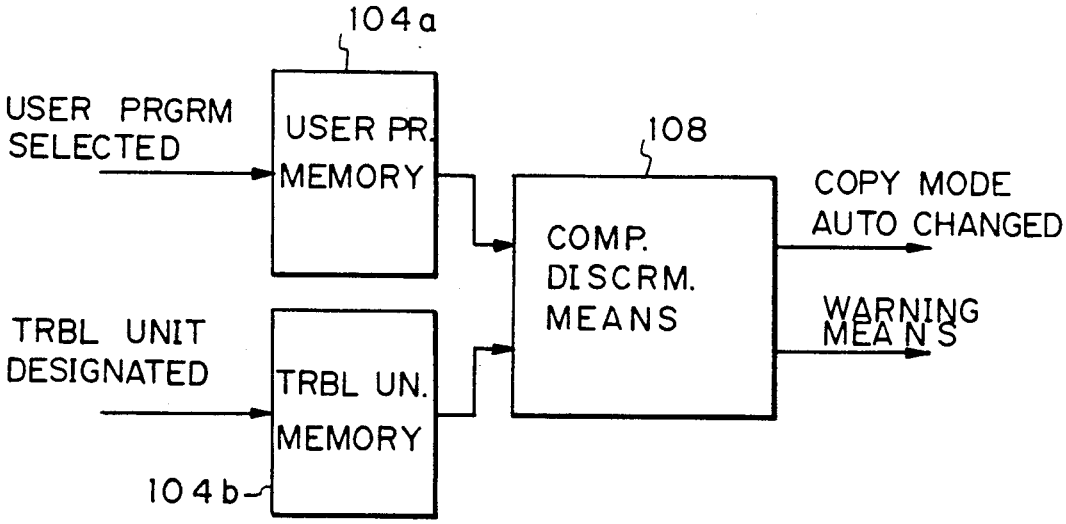
FIG. 13 is a block diagram of a part of the control system of FIG. 12.
Figure 14:
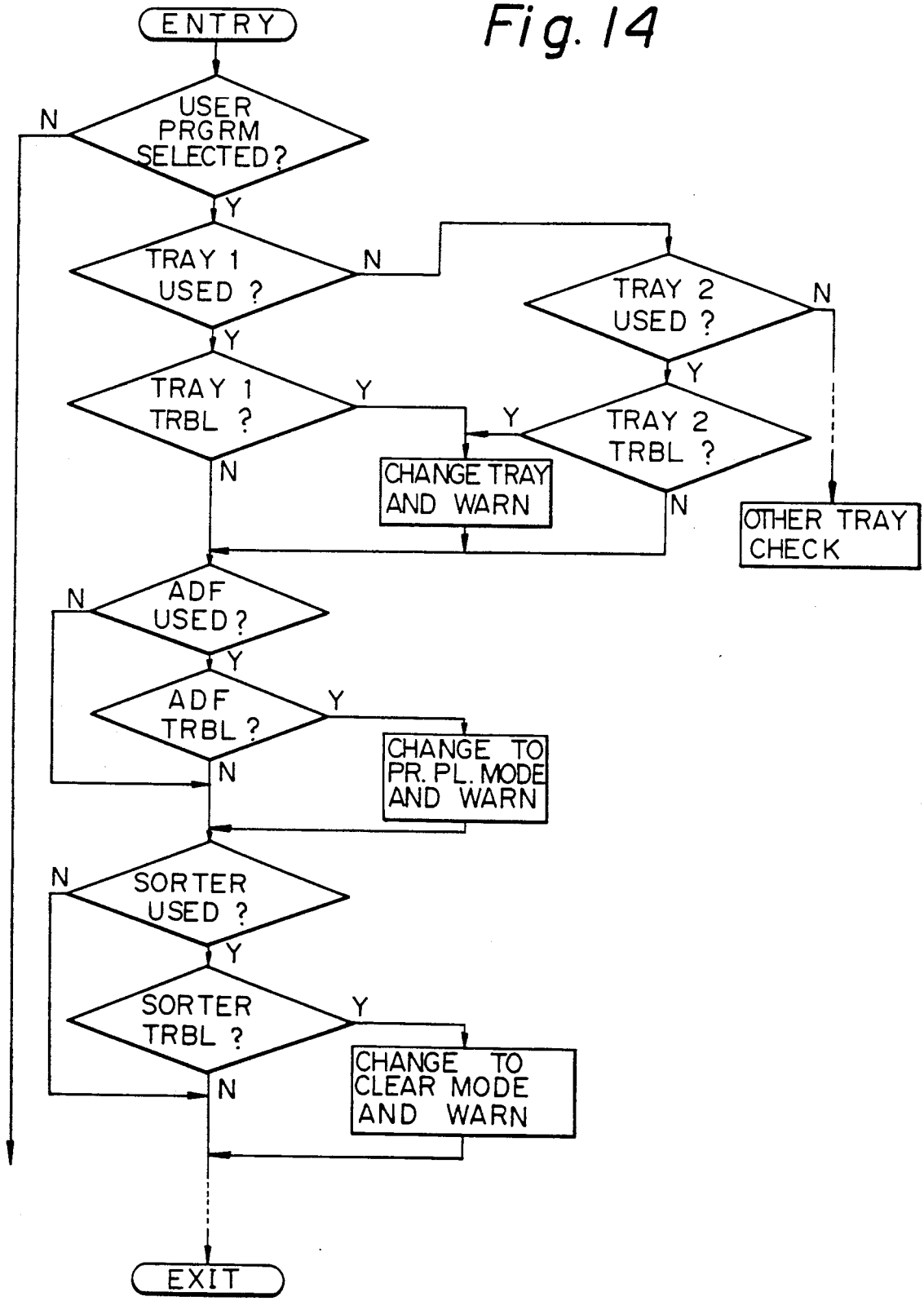
FIG. 14 is a flow chart of the control system of FIG. 12.

The control system for performing the function to cope with the troubled situation mentioned above is represented in block diagrams of FIGS. 12 and 13 and a flow chart of FIG. 14, respectively. FIG. 12 is a block diagram illustrating a whole control system of the copying apparatus comprising a microprocessor CPU 100 which processes the program of the copying apparatus. To the microprocessor CPU 100 are connected a ROM 102 for storaging programs for controlling the copying system, a RAM 103, a nonvolatile memory 104, an input-output port 105 and a serial communication control unit 106, through a bus line 101 for controlling and addressing data.

To the input-output port 105 are connected output loads such as motors and solenoids installed in the copying apparatus and input sources for sensors. Also, to the serial communication control unit 106 is connected an operating display 107 which is equivalent to the operating panel 25 mentioned before for the transmission and reception of signals therebetween.

With reference to FIG. 13, a user program memory circuit **104*a* is arranged in the nonvolatile memory 104 (FIG. 12**) and stores a plurality of copying function modes. The user program memory circuit stores copying modes which are often used and can be input by the user thereinto. Each of the stored copying modes can be called from the memory at any time necessary for operating the copying apparatus in that mode. Those modes are usually numbered by simple numerals such as 1 to 10 to manage the modes.

A trouble unit memory circuit **104*b* is also arranged in the nonvolatile memory 104** and stores information of a failure situation with respect to every unit, which information is erasable and writable each time a failure occurs or the unit is repaired.

When the user program is selected, a corresponding copying mode is called from the user program memory circuit **104*a*. After that, as can be seen from the flow chart of FIG. 14, a paper feed tray to be used is determined and the failure information of the tray is checked. More precisely, the failure information of the selected tray is called from the trouble unit memory circuit 104*b* and checked if the tray is in trouble by a relation discrimination means 108. If the tray is out of order, the copying mode is automatically changed to another copying mode in which another tray is used instead of the tray in trouble. Also, simultaneously with changing the copying mode, information that the copying mode is changed is displayed on a operating display panel 107** as a warning message. This is because it may not be desirable for the user to use another paper tray though it is possible to use the tray.

After that, as represented in the flow chart, the CPU discriminates whether the copying mode uses the automatic document feeder or not. If the automatic document feeder is to be used, the failure information thereof is checked so as to discriminate whether the automatic document feeder is in trouble or not. If the automatic document feeder is out of order, the copying mode is automatically changed to one which uses a pressing plate instead of the automatic document feeder and the warning message that the copying mode is changed is displayed. Such a process is also applied to the other units and function modes. Therefore, it becomes possible to avoid that the unit which is out of order is mistakenly used when operating the copying apparatus in a copying mode which is automatically selected by the user program.

Many widely different embodiments of the present invention may be constructed without departing from the spirit and scope of the present invention. It should be understood that the present invention is not limited to the specific embodiments described in the specification, except as defined in the appended claims.

What is claimed is:

1. A function selectable operating panel of a copying apparatus having an operation mode for setting a function selected from a plurality of functions of the copying apparatus, the operating panel comprising;

a display surface provided with a touch panel sensor means for designating a function from said plurality of functions;

the designated function being deleted from the display surface for prohibiting use of the designated function when the designated function is determined to be inoperative.

2. A function selectable operating panel of a copying apparatus according to claim 1, wherein the designated function includes at least one of a plurality of paper feed trays, a plurality of sorters, an automatic document feeder, a double-side copying unit, a binding margin spacing unit and a variable magnification unit.

3. A function selectable operating panel of a copying apparatus including an operation mode for setting a function selected from a plurality of functions of the copying apparatus, the operating panel comprising:

a display surface provided with a touch panel sensor means for designating a function from said plurality of functions;

the designated function being deleted from the display surface for prohibiting use of the designated function when the designated function is determined to be inoperative;

the operating panel representing a display of a menu of items which can be selectively designated by a user and the menu includes, as the operation mode for setting a function to be deleted, an option construction and function setting mode for designating option units provided for the copying apparatus and functions not to be used and a trouble function deleting mode for deleting a function which is inoperative.

4. A function selectable operating panel of a copying apparatus according to claim 3, wherein the designated function includes at least one of a plurality of paper feed trays, a plurality of sorters, an automatic document feeder, a double-side copying unit, a binding margin spacing unit and a variable magnification unit.

5. A function selectable operating panel of a copying apparatus having an operation mode for setting a function selected from a plurality of functions of the copying apparatus, the operating panel comprising:

a display surface provided with a touch panel sensor means for designating a function from said plurality of functions;

the designated function being deleted from the display surface for prohibiting use of the designated function when the designated function is determined to be inoperative, wherein by designating one of the operation modes in the menu on the display surface, the designated mode is represented in the display surface so that functions to be deleted can be designated on the display surface.

6. A function selectable operating panel of a copying apparatus according to claim 5, wherein the designated function includes at least one of a plurality of paper feed trays, a plurality of sorters, an automatic document feeder, a double-side copying unit, a binding margin spacing unit and a variable magnification unit.

7. A function selectable operating panel of a copying apparatus having an operation mode for setting a function selected from a plurality of functions of the copying apparatus, the operating panel comprising:

a display surface provided with a touch panel sensor means for designating a function from said plurality of functions;

the designated function being deleted from the display surface for prohibiting use of the designated function when the designated function is determined to be inoperative, wherein the display of functions designated not to be used and to be deleted in each of the operation mode are erased from the display surface representing a state of being to copy and inputs from switching composed of the touch panel sensor means are made inoperative with respect to the functions erased from the display surface.

8. A function selectable operating panel of a copying apparatus according to claim 7, wherein the designated function includes at least one of a plurality of paper feed trays, a plurality of sorters, an automatic document feeder, a double-side copying unit, a binding margin spacing unit and a variable magnification unit.

9. A function selectable operating panel of a copying apparatus having an operation mode for setting a function selected from a plurality of functions of the copying apparatus, the operating panel comprising:

a display surface provided with a touch panel sensor means for designating a function from said plurality of functions;

the designated function being deleted from the display surface for prohibiting use of the designated function when the designated function is determined to be inoperative, wherein each function which is used in a copying mode selected by a user is checked whether it is inoperative or not and when it is inoperative the copying mode is automatically changed to another mode in which the inoperative function is not used and information on the change of the copying mode is represented in the display surface to warn the user of the copying mode change.

10. A function selectable operating panel of a copying apparatus according to claim 9, wherein the designated function includes at least one of a plurality of paper feed trays, a plurality of sorters, an automatic document feeder, a double-side copying unit, a binding margin spacing unit and a variable magnification unit.

11. A function selectable operating panel of a copying apparatus having an operation mode for setting a function selected from a plurality of functions of the copying apparatus, the operating panel comprising:

a display device provided with a touch panel sensor means for designating a function from said plurality of functions;

a first display mode for designating functions with respect to the copying operation;

a second display mode for designating to delete a specified function in the functions with respect to the copying operation; and a control device for deleting the specified function designated in the second display mode from the first display mode, the designated function being deleted from the display surface for prohibiting use of the designated function when the designated function is determined to be inoperative, the operating panel being adapted to serve both in the first display mode and the second display mode.

12. A function selectable operating panel of a copying apparatus according to claim 11, wherein the control device is adapted to make the deleted function returning due to redesignating the deleted function in the second display mode.

* * * * *